US006877519B2

(12) United States Patent
Fink

(10) Patent No.: US 6,877,519 B2
(45) Date of Patent: Apr. 12, 2005

(54) COLLAPSIBLE SIDE WHEELED WALKER

(76) Inventor: Daniel J. Fink, 8016 Matterhorn Ct., Potomac, MD (US) 20854

( * ) Notice: Subject to any disclaimer, the term of this patent is extended or adjusted under 35 U.S.C. 154(b) by 19 days.

(21) Appl. No.: 10/445,890

(22) Filed: May 28, 2003

(65) Prior Publication Data

US 2003/0221715 A1 Dec. 4, 2003

Related U.S. Application Data

(60) Provisional application No. 60/383,621, filed on May 29, 2002.

(51) Int. Cl.[7] ..... A61H 3/00

(52) U.S. Cl. ..... 135/67; 135/85; 280/47.34; 280/646; 280/87.021; 482/68

(58) Field of Search ..... 135/65, 67, 85; 280/62, 641–646, 47.2, 47.371, 47.34, 87.021, 239, 66–68

(56) References Cited

U.S. PATENT DOCUMENTS 2,244,869 A * 6/1941 Everest et al. ..... 135/68
2,249,123 A * 7/1941 Leon et al. ..... 280/645
2,518,763 A * 8/1950 Du Bois ..... 135/67
3,999,565 A * 12/1976 Delacour et al. ..... 135/65
4,159,110 A * 6/1979 Dodenhoff ..... 482/68
4,526,390 A * 7/1985 Skolnik ..... 280/87.041
4,962,781 A * 10/1990 Kanbar ..... 135/65
5,647,602 A * 7/1997 Nevin ..... 280/87.021
6,217,056 B1 * 4/2001 Tsuchie ..... 280/639
6,338,355 B1 * 1/2002 Cheng ..... 135/67
6,478,104 B1 * 11/2002 Kemper ..... 280/642

FOREIGN PATENT DOCUMENTS

FR 2737993 * 2/1997
JP 2002-65776 * 3/2002

* cited by examiner

*Primary Examiner*—Winnie Yip
(74) *Attorney, Agent, or Firm*—Rothwell, Figg, Ernst & Manbeck

(57) ABSTRACT

A collapsible side wheeled walker accommodates a user walking to one side of the walker while holding the walker and supporting at least a portion of the user's weight on the walker. The walker can be collapsed in a tripod-like manner into a compact configuration that is easily transported and stowed.

19 Claims, 6 Drawing Sheets

COLLAPSIBLE SIDE WHEELED WALKER

CROSS-REFERENCE TO RELATED APPLICATIONS

This application claims priority to Provisional Application Ser. No. 60/383,621, filed May 29, 2002, the disclosure of which is incorporated by reference.

BACKGROUND OF THE INVENTION

1. Field of the Invention

The invention relates to walkers, and in particular, to collapsible walkers with wheels.

2. Description of the Related Art

Wheeled walkers may be used as a walking aid by people who are temporarily or permanently disabled and who may have difficulty walking unaided. Some walkers roll on three or four sets of wheels. Some walkers have handles that are grasped by the user. The user holds the handles for support and pushes the walker forward as the user walks. These walkers are often pushed in front of the user, and thus provide generally symmetric support.

Some people, however, have asymmetric disabilities. Asymmetric disabilities are those disabilities that affect one side of a person's body more than the other side. Polio or post-polio syndrome, for example, can produce muscular weaknesses or structural deformities on one side of a person's body. Some stroke or accident victims may be affected similarly. Asymmetric disabilities thus create a need for support on one side of a person's body.

A cane is an example of a support on one side of a person's body. A cane is placed on the ground to support a person between steps. A cane, therefore, provides cyclical support synchronized with a person's gait. There are people, however, who need a constant, steady support. The intermittent support offered by a cane may not be an acceptable solution for many of these people.

Walkers often have to be picked up and carried during use. Walkers may need to be picked up, for example, when climbing stairs, entering vehicles, crossing barriers, or traversing narrow doorways. Walkers also need to be stored in compartments such as closets, overhead bins on airplanes and buses, automobile trunks, and under seats in theaters or restaurants. It would be desirable therefore for a walker to collapse down to the smallest possible size for case of transport and storage.

SUMMARY OF THE INVENTION

The foregoing, and other, shortcomings of conventional walkers are overcome by a collapsible side-wheeled walking aid for assisting a user walking to one side of said aid. The walking aid is selectively configurable in either a functional or a stowable state and includes a frame having three frame members interconnected with one another proximate upper ends thereof. At least two of the frame members are interconnect so as to be moveable between first and second positions. In the first positions, when the aid is in the functional state, the frame members extend away from each other toward lower ends thereof so that the frame is in a stable, weight supporting configuration. In the second positions, when the aid is in the stowable state, the lower ends of the frame members are in close proximity to each other so that the frame is in a compact configuration. A wheel assembly is disposed on a lower end of at least one of the frame members. A handle is disposed on an upper end of the frame. The handle is constructed and arranged in relation to the frame to permit a user to grasp the handle with one hand and to walk while supporting at least a portion of the user's weight on the aid while rolling the frame on the wheel assembly with the aid positioned to one side of the user.

In one embodiment, the walker includes a frame generally having the shape of a triangular pyramid and including a main leg, a rear, and a side leg. The main, rear, and side legs are interconnected proximate a vertex of the pyramid. At least two of the legs are connected within the frame so as to be pivotable with respect to the third leg when the frame is collapsed.

DETAILED DESCRIPTION OF THE PREFERRED EMBODIMENTS

Figure 1:
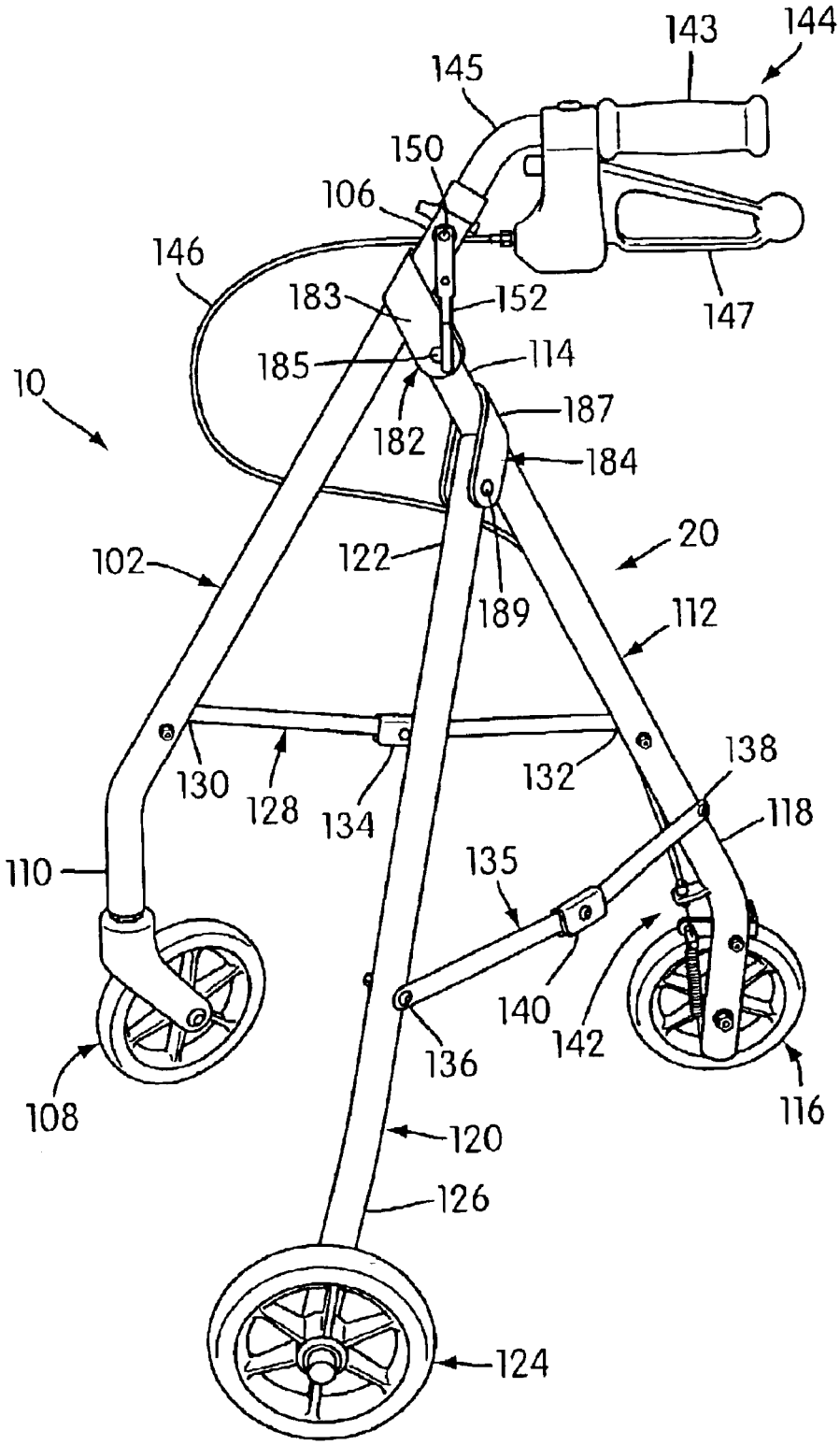
FIG. 1 is a perspective view of an embodiment of the collapsible side wheeled walker of the present invention in use.
Figure 2:
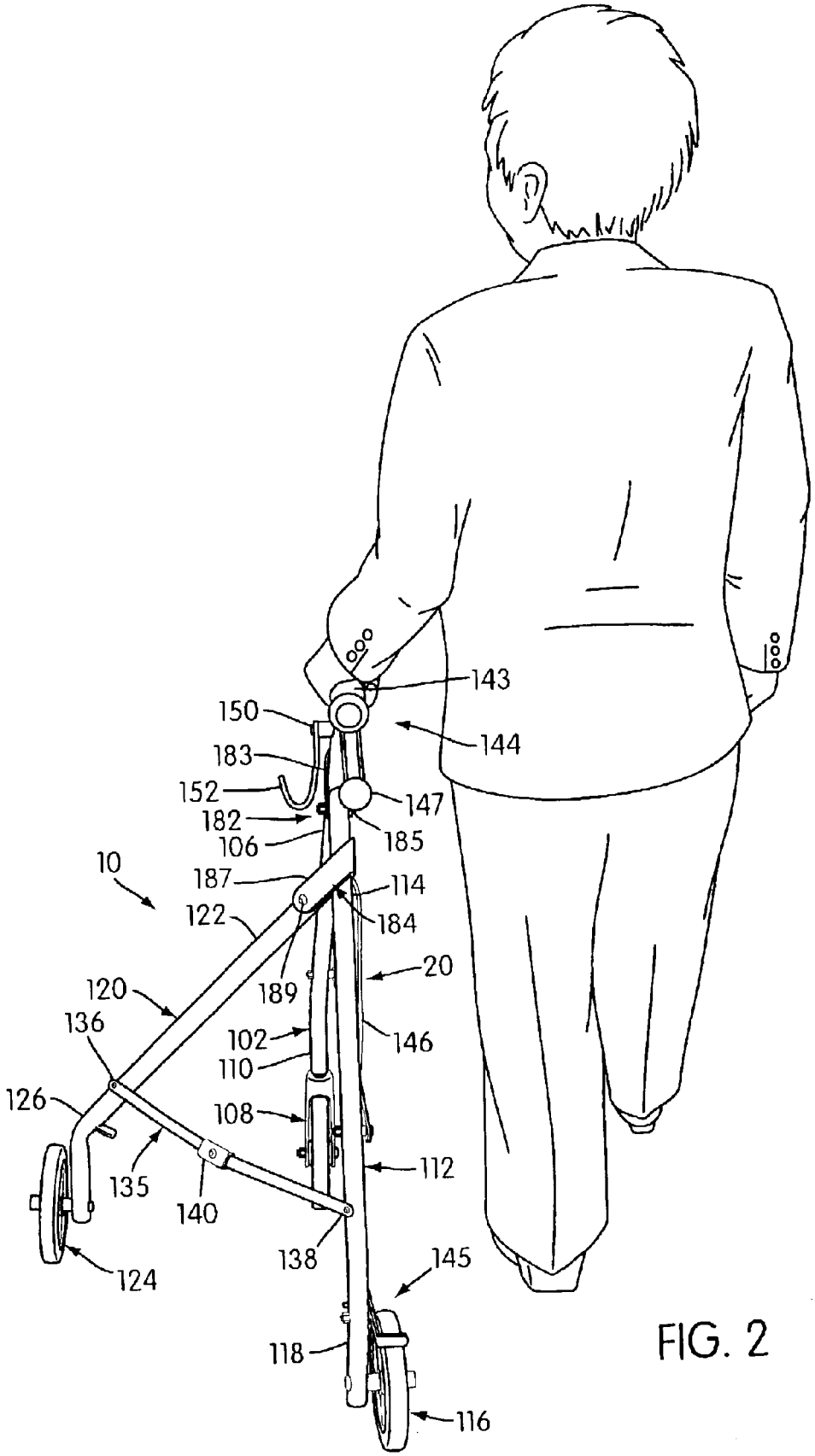
FIG. 2 is a rear view of the embodiment of the collapsible side wheeled walker shown in FIG. 1 in use.
Figure 3:
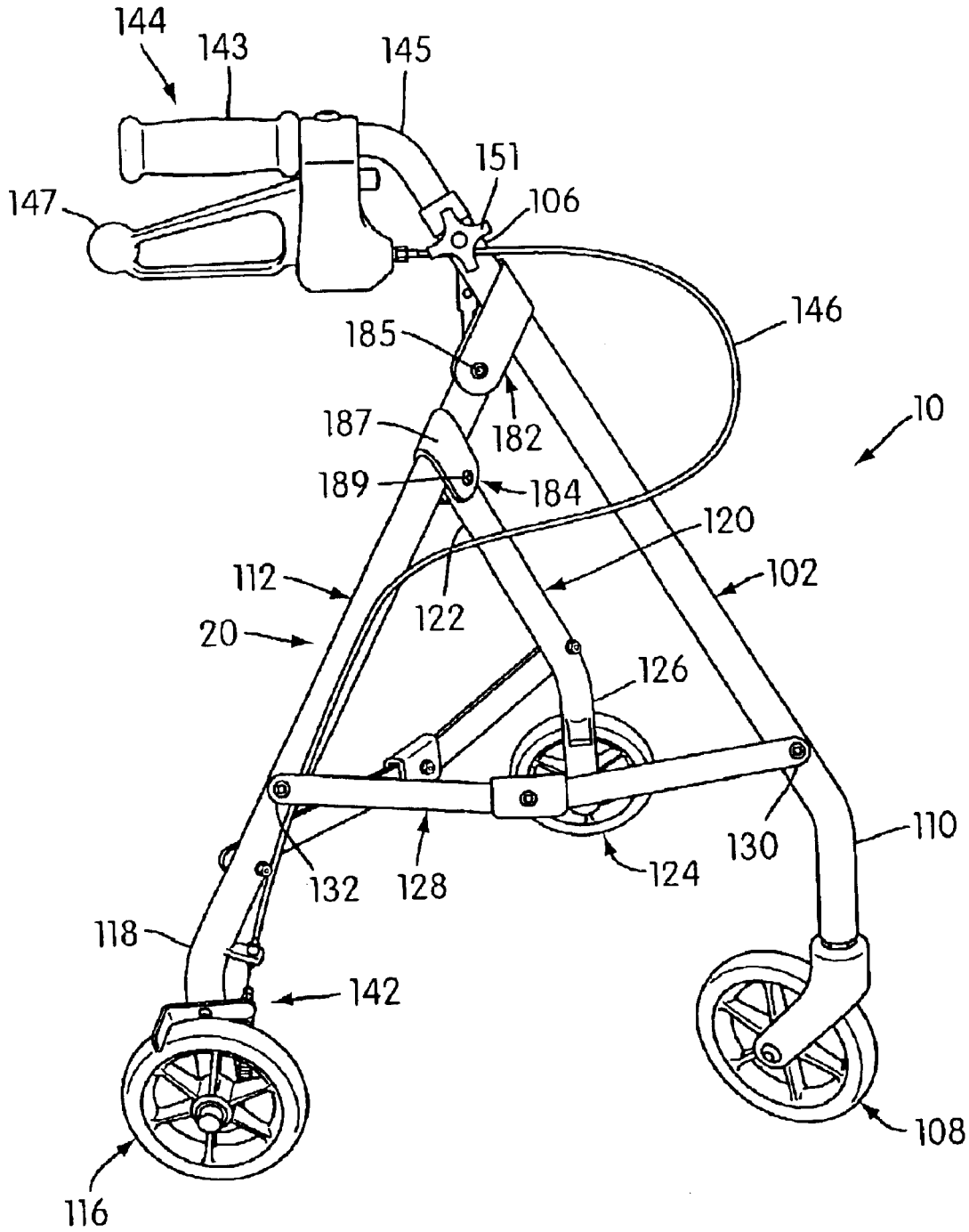
FIG. 3 is a side view of the embodiment of the collapsible side wheeled walker shown in FIG. 1.
Figure 4:
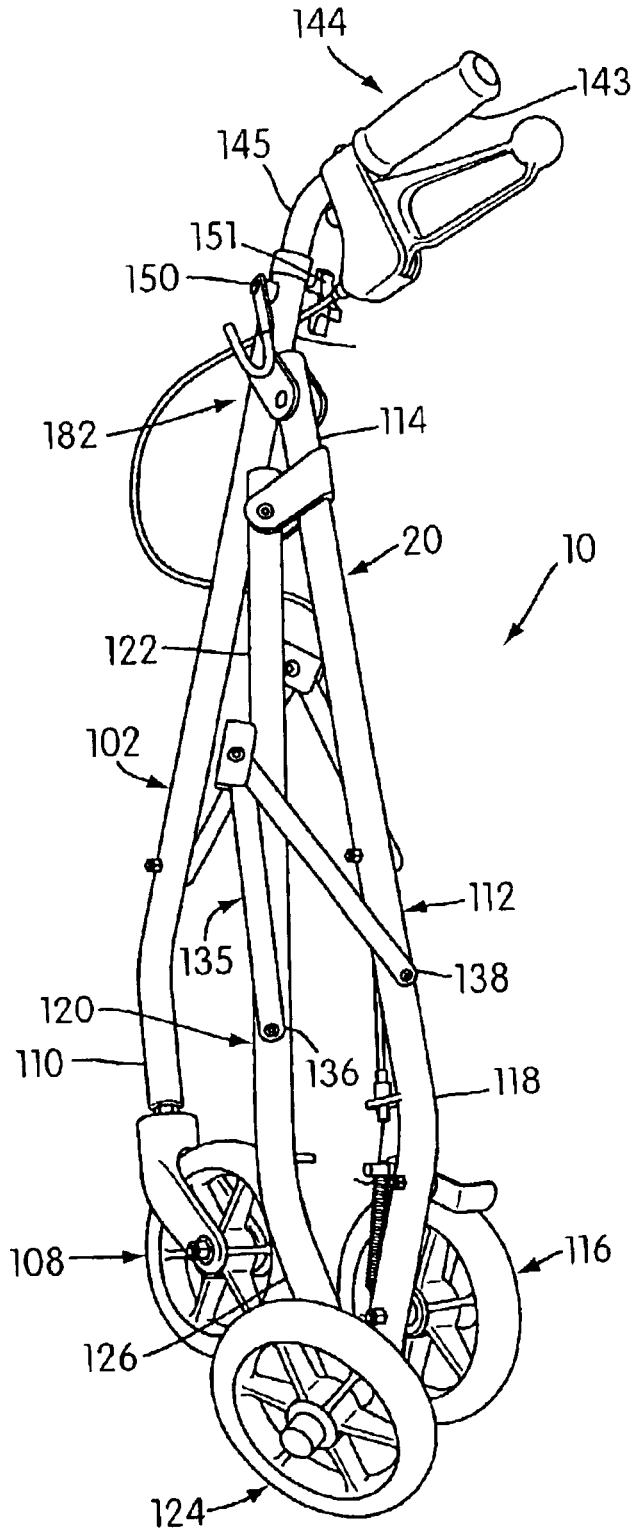
FIG. 4 is a view of the embodiment of the collapsible side wheeled walker shown in FIG. 1 in a collapsed configuration.

A collapsible walking aid (or walker) is shown in FIGS. 1 through 4. Aid 10 is adapted to be selectively reconfigured in either the functional state shown in FIGS. 1–3 or the stowable state shown in FIG. 4. Walking aid 10 includes a frame 20. Frame 20 includes three leg members 102, 112, 120 interconnected proximate their respective upper ends 106, 114, 122. The leg members 102, 112, 120 are interconnected so as to be movable between first positions extending away from each other toward their respective lower ends 110, 118, 126 so that frame 20 is in a stable, weight-supporting configuration, as shown in FIGS. 1–3, when the aid 10 is in its functional state and second positions in which the lower ends 110, 118, 126 of the frame members are in close proximity with each other, as shown in FIG. 4, when the aid 10 is in the stowable state. In the context of the present disclosure, "close proximity" means that the lower ends of adjacent frame members are physically separated by a distance that is significantly smaller than the physical distance separating the lower ends when not in close proximity to each other, i.e., when the walking aid 10 is in the functional state. Close proximity may or may not mean that the lower ends of adjacent frame members contact each other.

In the illustrated embodiment, collapsible walking aid 10 includes a main leg (or frame member) 102 having a main upper end 106 and a main wheel assembly 108 at a main lower end 110. Main wheel assembly 108 may be a single wheel as shown, or a set of wheels. Wheel assembly 108 is castered in the illustrated embodiment. Main leg 102 is preferably formed of a light weight, tubular material, such as extruded aluminum, or one of the many strong light-weight man-made materials, such as carbon-based composite materials.

A rear leg (or frame member) 112 having a rear upper end 114 is fastened pivotably to main upper end 106 of main leg 102 using a fastener 182. Rear leg 112 is preferably formed of a light weight tubular material, such as extruded aluminum, or one of the many strong light-weight man-made materials, such as carbon-based composites. Fastener 182 comprises a bracket 183 firmly secured to the upper end 106 of main leg 102. Bracket 183 may be secured to main leg 102 by mechanical fasteners (e.g., screws, bolts, rivets), by welding (if both bracket 183 and leg 102 are made of metal), by a suitable adhesive, or by any means for securely fastening bracket 183 to main leg 102. The upper end 114 of rear leg 112 is secured to bracket 183 by a pin 185 (for example a metal pin, a bolt, an axle, etc.) which allows rear leg 112 to pivot with respect to main leg 102. Rear leg 112 may have a rear wheel assembly 116 at a rear lower end 118. Rear wheel assembly 116 may be castered and may be a single wheel or a set of wheels.

A side leg (or frame member) 120 having a side upper end 122 is fastened pivotably to rear upper end 114 of rear leg 112 using a fastener 184. Side leg 120 is preferably formed of a light-weight tubular material, such as extruded aluminum, or one of the many strong man-made materials, such as carbon-based composites. Fastener 184 comprises a bracket 187 firmly secured to the upper end 114 of rear leg 112. Bracket 187 may be secured to the rear leg 112 by mechanical fasteners (e.g., screws, bolts, rivets), by welding (if both bracket 187 and leg 112 are made of metal), by a suitable adhesive, or by any means for securely fastening bracket 187 to leg 112. The upper end 122 of side leg 120 is secured to bracket 187 by a pin 189 (for example, a metal pin, a bolt, an axle, etc.) which allows side leg 120 to pivot with respect to rear leg 112. Side leg 120 is canted outwardly from main leg 102 and rear leg 112 when collapsible walker 10 is in its functional state to provide lateral support.

Side leg 120 may have a side wheel assembly 124 at a side lower end 126. Side wheel assembly 124 may include a single wheel or a set of wheels, and side wheel assembly 124 may be castered. It is preferable that only one or two of the legs 102, 112, 120 include a castered wheel assembly. As an alternative to the arrangement shown, side leg 120 may be pivotally attached toward an upper end 106 of main leg 102. In an alternate embodiment, the wheel assembly may be omitted from the side leg 120 and replaced by a ground engaging foot or pad attached to the lower end of leg 120.

Main, rear and side legs 102, 112, 120 thus form an interconnected frame 20, with side leg 120 connected to rear leg 112, and rear leg 112 connected in turn to main leg 102 to form a frame having the general shape of a triangular pyramid when the walking aid 10 is its functional state. Main, rear and side legs 102, 112, 120 are thus interconnected at or near the vertex of the pyramidal frame 20, and at least two of the legs (the rear leg 112 and side leg 120 in the illustrated embodiment) are pivotable with respect to the third leg (e.g. main leg 102) so that, when the frame 20 is collapsed, collapsible walking aid 10 occupies the smallest possible amount of space.

More specifically, as shown in the example embodiment illustrated in FIG. 4, main, rear and side legs 102, 112, 120 can be folded adjacent to each other in a tripod-like manner when the walker 10 is in its stowable state, making a compact package that may be easily transported or stored. Collapsible walking aid 10 may be stored easily in the baggage lockers and overhead bins above airline seats or under a seat in a theater or restaurant.

An asymmetric disability may affect either the left or the right side of a person. It would be desirable therefore for a user to be able to use the walker as either a left-handed walker or a right-handed walker. It would be further desirable for the walker to be easily convertible from a left-handed walker to a right handed walker, and vice-versa.

Side leg 120 may be oriented to extend to the right of main leg 102 for right-handed users or to the left of main leg 102 for left-handed users. In this embodiment, collapsible walker 10 may be used in a left handed orientation and a right handed orientation. Thus, in an alternate embodiment, bracket 187 of fastener 184 is removably fastened (e.g., by bolts or screws) to rear leg 112 so that the bracket 187 can be oriented and fastened to leg 102 pointing to the left or the right hand side of frame 20.

A handle 144 is positioned proximate an upper end of frame 20. Handle 144 includes a generally horizontally—oriented grasping portion 143 and a lower portion 145 arranged at an angle (obtuse in the illustrated example) with respect to grasping portion 143. Handle 144 is also made from a strong, light-weight tubular material, such as extruded aluminum or a man-made material such as a carbon-based composite. Portion 145 fits telescopically with respect to the upper portion 106 of the main leg 102. Handle 144 is preferably secured by a pin 150 extending into leg 102 and into one of a plurality of aligned, longitudinally-spaced apertures (not shown) formed in the lower portion 145 when one of the apertures of the lower portion is aligned with pin 150. In the illustrated example, pin 150 is a threaded rod with a head at one end and a star-shaped, manually operable threaded nob 151 at an opposite end. In one embodiment shown in FIGS. 1 and 2, pin 150, (e.g., a bolt and nut combination) also secures a utility hook 152 to the frame 20. Accordingly, the height of the gripping portion 143 may be adjusted by sliding the lower portion 145 relative to leg 102 and inserting the pin 150 into one of the apertures formed in lower portion 145 so as to secure the handle 144 with the gripping portion 143 at the desired height.

A first foldable strut 128 is fastened pivotably to main leg 102 at a first end 130 and to rear leg 112 at a second end 132. First foldable strut 128 has a first hinge 134 disposed substantially intermediate between first end 130 and second end 132. First foldable strut 128, main leg 102 and rear leg 112 form a frame in the shape of a triangle when collapsible walker 10 is set up for use in the functional state.

A second foldable strut 135 is fastened pivotably to side leg 120 at a first end 136 and to rear leg 112 at a second end 138. Second foldable strut 135 includes a second hinge 140 disposed substantially intermediate between first end 136 and second end 138. Second foldable strut 135, side leg 120 and rear leg 112 form a frame in the shape of a triangle when collapsible walker 10 is set up for use in the functional state. If side leg 120 is pivotally connected to main leg 102, strut 135 would preferably be pivotally connected at its ends 138, 136 to main leg 102 and side leg 120.

First and second hinges 134, 140 are lockable when collapsible walker 10 is in the functional state and are releasable when collapsible walker 10 is collapsed in the stowable state. More specifically, first and second hinges 134, 140 are locking, over-center hinges. Suitable alternative locking hinges include clasp hinges and sliding bar hinges.

Figure 5A:
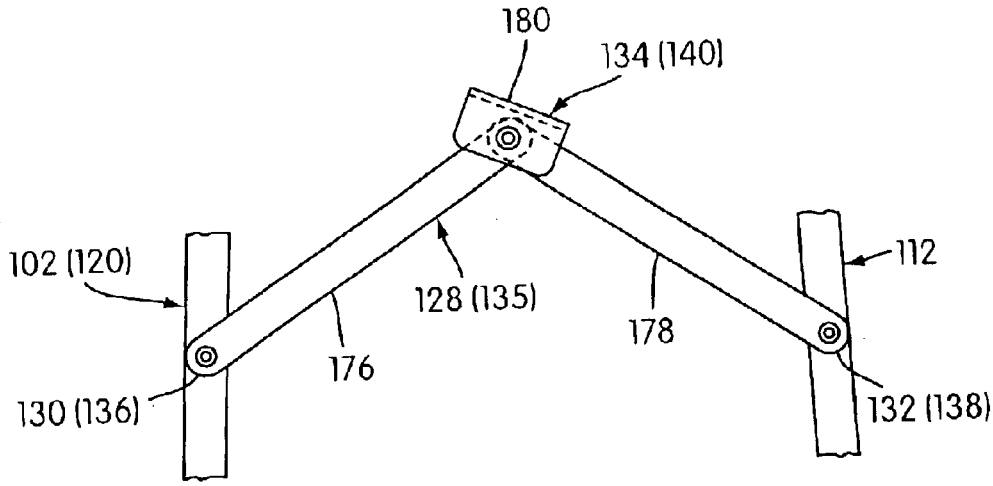
FIGS. 5A–5C are partial views of a foldable strut in accordance with one aspect of the invention.
Figure 5B:
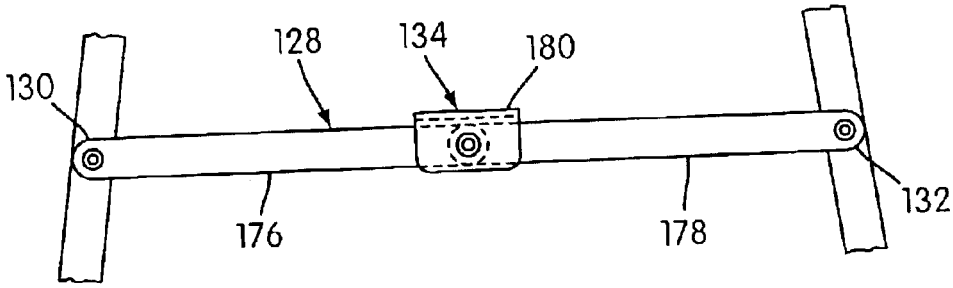
Figure 5C:
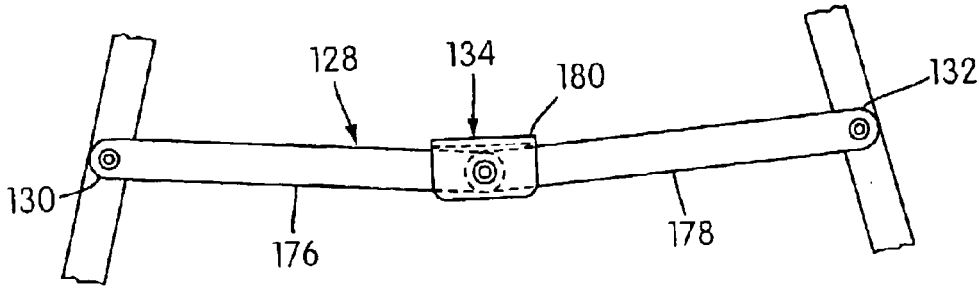

In a conventional manner, illustrated in FIGS. 5A–5C, over-center locking hinge 134 (140) permits halves 176 and 178 of first strut 128 to pivot in one direction about their anchor points 130 and 132, connected to main leg 102 and rear leg 112, respectively, to permit main leg 102 and rear leg 112 to collapse with respect to each other. To lock the strut 128 in the extended position, halves 176, 178 are moved past an aligned arrangement to an over-center position, shown in FIGS. 5B and 5C, into a position where further rotation of the halves 176, 178 is arrested by contact with stop 180.

To collapse the collapsible walker, the locking action is overcome by applying an upward force on the middle of the strut 135 to relieve the over-center condition. Second hinge 140 may be designed similarly.

In the example shown, the walker 10 includes a braking mechanism for selectively arresting rolling progress of the walker. More specifically, as shown in FIGS. 1–3 and 7, a brake 142 is disposed proximate to rear wheel assembly 116. A lever 147 is pivotably connected to handle 104. A tension member 146 is connected at a first end to lever 147 and at a second end to brake 142.

Figure 6:
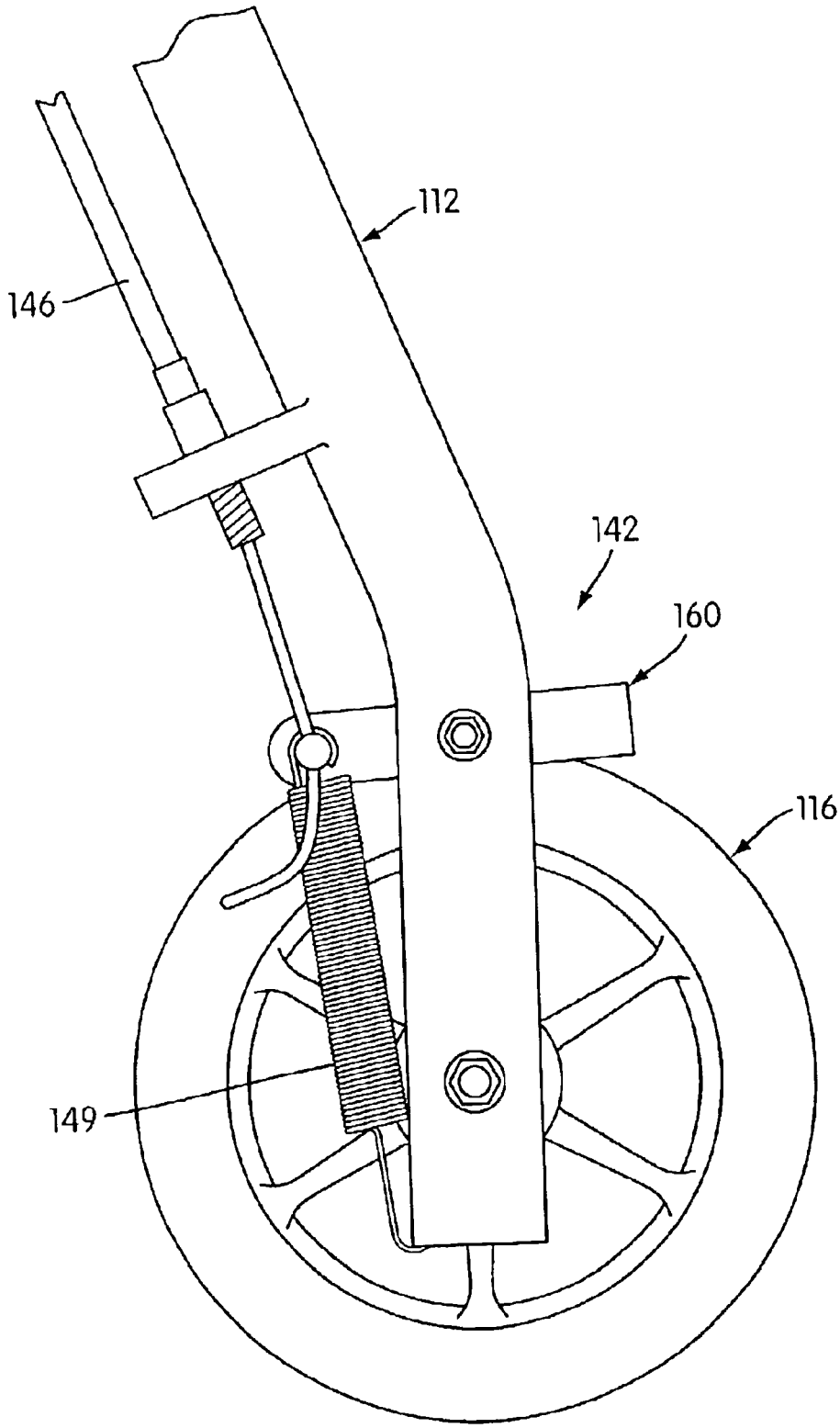
FIG. 6 is a partial view of a wheel and brake mechanism of an embodiment of the invention.

In the embodiment shown in FIG. 6, brake 142 includes an L-shaped member 145 pivotally connected to rear leg 112. Upon activation of the lever 147, tension member 146 transmits a pivoting force to member 145 causing a lower end thereof into braking engagement with wheel 116. Spring 149 causes the member 145 to disengage when the handle 147 is released. Tension member 146 urges rear brake 142 into braking engagement with rear wheel 116 when lever 147 is pivotably actuated. Tension member 146 may be a cable, a wire, a rope, or a chain in various embodiments. As is conventional in such manually actuated braking mechanisms, one or more resilient members (e.g., springs) are operatively arranged to relieve the braking engagement when lever 147 is released. Moreover, a locking mechanism (not shown) may be provided (preferably on or near handle 147) for selectively locking the handle in the braking actuated position when released to provide a "parking brake" functionality.

Braking mechanisms may also be provided on main wheel assembly 108 and/or side wheel assembly 124, and the multiple braking mechanisms may operate independently or in conjunction with each other. Alternative braking mechanisms include bicycle-style caliper brakes.

In use, collapsible walker 10 may be held to the side of a user (as shown in FIG. 2), supporting the user while the user walks forward at a rate of speed of the users choosing. The user grasps the gripping portion 143 of the handle 144 on the top of main leg 102, which is supported by side leg 120 having side wheel assembly 124 and rear leg 112 having rear wheel assembly 116. While walking, with wheel assemblies 108, 116, and 124 rolling on the ground, the user can support some portion of his or her weight on the walker 10 to help the user maintain his or her balance. Similarly, the user may use the walker as a balance aid when standing still. If the wheel assembly 124 is omitted from side leg 120, the user tips the walker slightly inwardly to lift the lower end of side leg 120 off the ground and thereafter walks supporting some portion of his or weight on the main leg 108 and rear leg 112.

While the invention has been described in detail above, the invention is not intended to be limited to the specific embodiments as described. It is evident that those skilled in the art may now make numerous uses and modifications of and departures from the specific embodiments described herein without departing from the inventive concepts.

What is claimed is:

1. A collapsible walker for use as an aid in walking, said collapsible walker comprising:

a frame generally having the shape of a triangular pyramid and including a main leg, a rear leg, and a side leg being pivotally interconnected proximate a vertex of said pyramid, wherein at least two of said main, rear, and side legs are collapsible onto the third of said legs when said frame is collapsed;

a wheel assembly disposed at a ground-engaging position on at least two of said main, rear, and side legs; and a handle disposed at an upper end of said frame and adapted to be grasped by a user with one hand while walking to permit the user to support some portion of the user's weight on said frame while rolling said wheel assemblies along the ground.

2. The collapsible walker of claim 1, wherein said rear leg is pivotably connected to said main leg, and said side leg is pivotably connected to said rear leg.

3. The collapsible walker of claim 1, said frame further including a collapsible strut operatively mounted between two of said main, rear, and side legs.

4. The collapsible walker of claim 3, including a first collapsible strut operatively mounted at opposite ends thereof to each of said main leg and said rear leg and a second collapsible strut operatively mounted at opposite ends thereof to each of said rear leg and said side leg.

5. The collapsible walker of claim 1, further comprising a brake mechanism adapted to selectively arrest rolling movement of a one of said wheel assemblies.

6. The collapsible walker of claim 5, wherein said brake mechanism comprises a manually actuable lever disposed proximate said handle, an engagement member disposed adjacent said wheel assembly and adapted for movement between a first position unengaged with said wheel assembly and a second position in braking engagement with said wheel assembly, and a tension member extending between said lever and said engagement member for transferring motion of said lever to said engagement member for urging said engagement member into said second position.

7. The collapsible walker of claim 1, wherein each wheel assembly comprises a single wheel.

8. The collapsible walker of claim 1, wherein at least one of said wheel assemblies is castered.

9. The collapsible walker of claim 1, wherein said frame is oriented such that said main and rear legs lie substantially in a common vertical plane and said side leg extends to one side or the other of said plane.

10. A walking aid for assisting a user walking to one side of said aid and being selectively configurable in either a functional or a stowable state, said aid comprising:

a frame having three frame members interconnected with one another proximate upper ends thereof, at least two of said frame members being interconnect so as to be moveable between (1) first positions extending away from each other toward lower ends thereof so that said frame is in a stable, weight supporting configuration when said aid is in the functional state, and (2) second positions in which the lower ends of said frame members are in close proximity to each other so that said frame is in a compact configuration when said aid is in the stowable state;

a wheel assembly disposed on a lower end of at least one of said frame members; and a handle disposed on an upper end of said frame, said handle being constructed and arranged in relation to said frame to permit a user to grasp the handle with one hand and to walk while supporting at least a portion of the user's weight on the aid while rolling the frame on said wheel assembly with the aid positioned to one side of the user.

11. The walking aid of claim 10, wherein said frame comprises a main frame member, a rear frame member, and a side frame member and said rear frame member is pivotably connected to said main frame member, and said side frame member is pivotably connected to said rear frame member.

12. The walking aid of claim 10, said frame further including a collapsible strut operatively mounted between two of said three frame members.

13. The walking aid of claim 11, including a first collapsible strut operatively mounted at opposite ends thereof to each of said main frame member and said rear frame member and a second collapsible strut operatively mounted at opposite ends thereof to each of said rear leg member and said side frame member.

14. The walking aid of claim 10, further comprising a brake mechanism adapted to selectively arrest rolling movement of a one of said wheel assemblies.

15. The walking aid of claim 14, wherein said brake mechanism comprises a manually actuable lever disposed proximate said handle, an engagement member disposed adjacent said wheel assembly and adapted for movement between a first position unengaged with said wheel assembly and a second position in braking engagement with said wheel assembly, and a tension member extending between said lever and said engagement member for transferring motion of said lever to said engagement member for urging said engagement member into said second position.

16. The walking aid of claim 10, wherein each wheel assembly comprises a single wheel.

17. The walking aid of claim 10, wherein at least one of said wheel assemblies is castered.

18. The walking aid of claim 10, wherein the height of said handle is adjustable.

19. The walking aid of claim 10, wherein at least two of said three frame members are connected within said frame so as to be pivotable with respect to at least one other frame member.

* * * * *